US009169746B2

(12) United States Patent
Hayashi et al.

(10) Patent No.: US 9,169,746 B2
(45) Date of Patent: Oct. 27, 2015

(54) VALVE TIMING ADJUSTING SYSTEM

(71) Applicant: DENSO CORPORATION, Kariya, Aichi-pref. (JP)

(72) Inventors: Masashi Hayashi, Okazaki (JP); Tomonori Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 91 days.

(21) Appl. No.: 14/063,434

(22) Filed: Oct. 25, 2013

(65) Prior Publication Data

US 2014/0144399 A1 May 29, 2014

(30) Foreign Application Priority Data

Nov. 28, 2012 (JP) ..... 2012-259609

(51) Int. Cl.
*F01L 1/34* (2006.01)
*F01L 1/344* (2006.01)

(52) U.S. Cl.
CPC ..... *F01L 1/3442* (2013.01); *F01L 2001/34469* (2013.01); *F01L 2800/11* (2013.01); *F01L 2800/12* (2013.01); *F01L 2820/041* (2013.01)

(58) Field of Classification Search
CPC ..... F01L 2001/34453; F01L 2001/34476; F01L 1/3442
See application file for complete search history.

(56) References Cited

U.S. PATENT DOCUMENTS

| | | | | |
|---|---|---|---|---|
| 2002/0043231 | A1 | 4/2002 | Hase | |
| 2010/0170461 | A1 | 7/2010 | Yokoyama et al. | |
| 2012/0055429 | A1 | 3/2012 | Nakamura et al. | |
| 2013/0199478 | A1 * | 8/2013 | Tanaka et al. | 123/90.17 |
| 2014/0048026 | A1 * | 2/2014 | Miyazato et al. | 123/90.15 |
| 2014/0090613 | A1 * | 4/2014 | Hayashi et al. | 123/90.15 |

FOREIGN PATENT DOCUMENTS

| | | |
|---|---|---|
| EP | 2 415 978 | 2/2012 |
| JP | 9-209723 | 8/1997 |
| JP | 2001-329870 | 11/2001 |
| JP | 2002-242630 | 8/2002 |
| JP | 2002-295207 | 10/2002 |
| JP | 2010-138727 | 6/2010 |

OTHER PUBLICATIONS

Office Action (2 pgs.) dated Oct. 21, 2014 issued in corresponding Japanese Application No. 2012-259609 with an at least partial English-language translation thereof (3 pgs.).

* cited by examiner

*Primary Examiner* — Thomas Denion
*Assistant Examiner* — Daniel Bernstein
(74) *Attorney, Agent, or Firm* — Nixon & Vanderhye P.C.

(57) ABSTRACT

A main angle-limiting mechanism mechanically limits a relative movement between a vane rotor and a housing within a main angular range. When a rotational phase difference between the vane rotor and the housing becomes out of the main angular range, for example, due to a breakage of the main angle-limiting mechanism, an electronic control unit sets a target value for the rotational phase difference. The target value is set at such a value within a restricted angular range, which is smaller than the main angular range.

19 Claims, 14 Drawing Sheets

VALVE TIMING ADJUSTING SYSTEM

CROSS REFERENCE TO RELATED APPLICATION

This application is based on Japanese Patent Application No. 2012-259609 filed on Nov. 28, 2012, the disclosure of which is incorporated herein by reference.

FIELD OF TECHNOLOGY

The present disclosure relates to a valve timing adjusting system for an internal combustion engine.

BACKGROUND

A valve timing adjusting device is known in the art, for example, as disclosed in Japanese Patent Publication No. 2002-295207.

According to the above prior art, the valve timing adjusting device is provided in a rotation transmitting system, in which rotation of an engine is transmitted from a driving shaft to a driven shaft of the engine for opening and closing an intake valve or an exhaust valve of the engine. In the valve timing adjusting device, pressure of working oil in an advancing chamber and a retarding chamber formed in a housing is changed to rotate a vane rotor relative to the housing, so that a valve opening/closing timing is controlled. A relative movement of the vane rotor to the housing is limited when one of vanes (a specific vane) is brought into contact with a partitioning wall of the housing.

According to the valve timing adjusting device, the specific vane may be broken or deformed by an impact force applied to the specific vane, when the specific vane is brought into contact with the partitioning wall. When the specific vane was broken or deformed, the vane rotor is further rotated beyond a predetermined angular range relative to the housing until another vane is brought into contact with another partitioning wall of the housing. As a result, a rotational phase difference between the vane rotor and the housing becomes larger, which may cause an adverse effect, such as, a contact between the valves, a contact between the valve and a piston, abnormal combustion and so on. Then, the engine may be damaged.

SUMMARY OF THE DISCLOSURE

The present disclosure is made in view of the above problem. It is an object of the present disclosure to provide a valve timing adjusting system, according to which a possible engine damage can be avoided.

According to a feature of the present disclosure, a valve timing adjusting system is composed of a housing, a vane rotor, an oil pressure control valve, an angular-position detecting member, a main angle-limiting mechanism and an electronic control unit. The vane rotor is rotatable relative to the housing within a predetermined angular range. The oil pressure control valve controls oil pressure in an advancing chamber and a retarding chamber formed in the housing in order to change a rotational phase difference between the vane rotor and the housing. The angular-position detecting member detects the rotational phase difference. The main angle-limiting mechanism mechanically limits a relative movement between the vane rotor and the housing, so that the rotational phase difference is controlled at a value within a main angular range, which is smaller than the predetermined angular range.

The electronic control unit has an abnormal condition detecting portion, a target-value setting portion and a valve driving portion. The abnormal condition detecting portion determines whether a detected rotational phase difference is out of the main angular range or not. The target-value setting portion sets a target value for the rotational phase difference when the abnormal condition detecting portion determines that the detected rotational phase difference is out of the main angular range, wherein the target value is set within a restricted angular range smaller than the main angular range. The valve driving portion drives the oil pressure control valve so that the rotational phase difference coincides with the target value.

The electronic control unit sequentially receives detection signals from the angular-position detecting member in order to control the oil pressure control valve, so that a difference between the detected rotational phase difference and the target value becomes smaller as quickly as possible. For example, when the rotational phase difference between the vane rotor and the housing becomes out of the main angular range as a result that the main angle-limiting mechanism is broken, the electronic control unit immediately controls the rotational phase difference at a value within the restricted angular range, which is smaller than the main angular range. Accordingly, a possible damage to the engine, which may be caused by the rotational phase difference being out of the main angular range, can be avoided.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
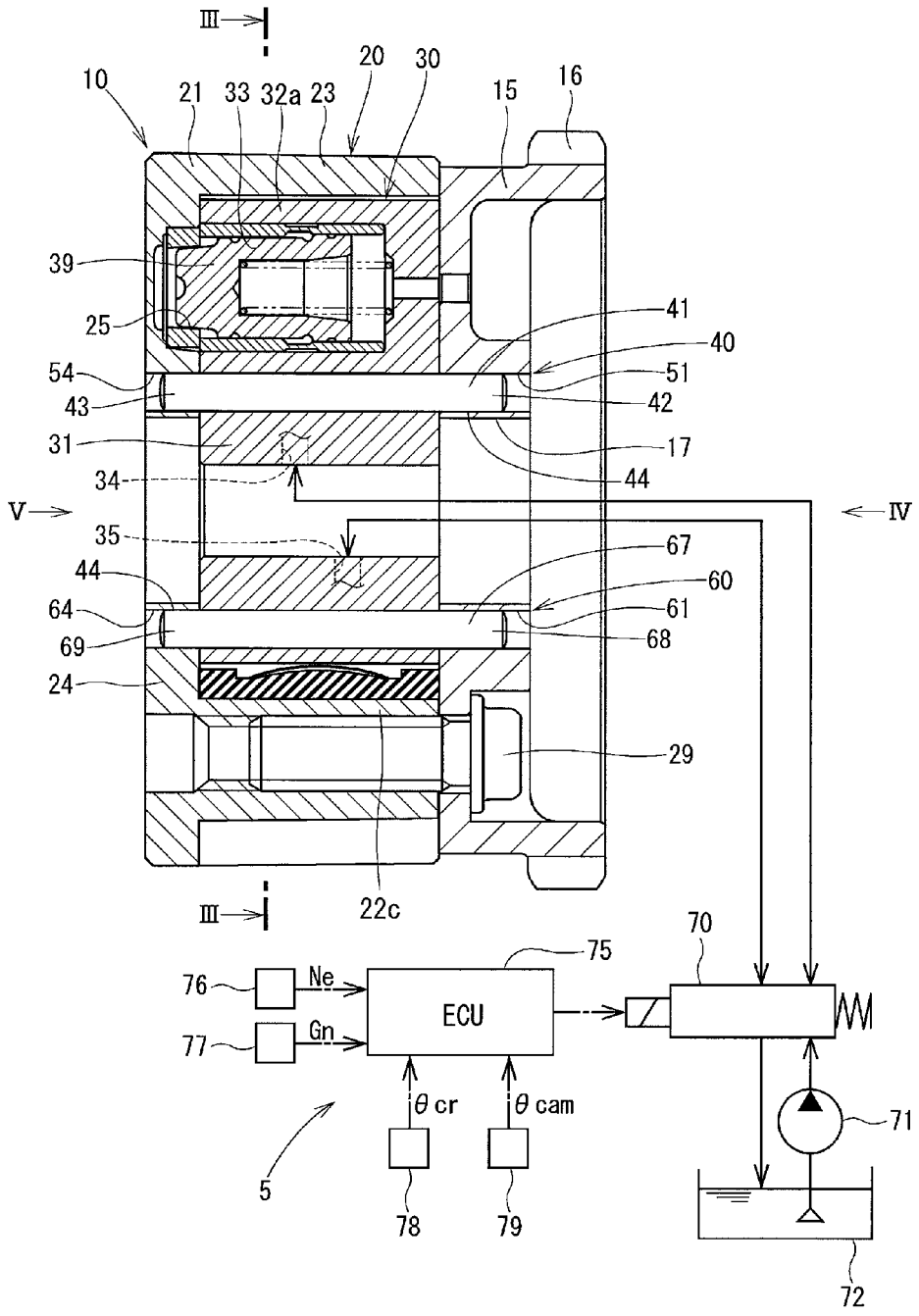
FIG. 1 is a view showing a structure of a valve timing adjusting system according to a first embodiment of the present disclosure, wherein a valve timing adjusting device is shown as a cross sectional view taken along a line I-I in FIG. 3.

The present disclosure will be explained hereinafter by way of multiple embodiments. The same reference numerals are given to the same or similar portions and/or structures throughout the embodiments, for the purpose of eliminating repeated explanation.

First Embodiment

Figure 2:
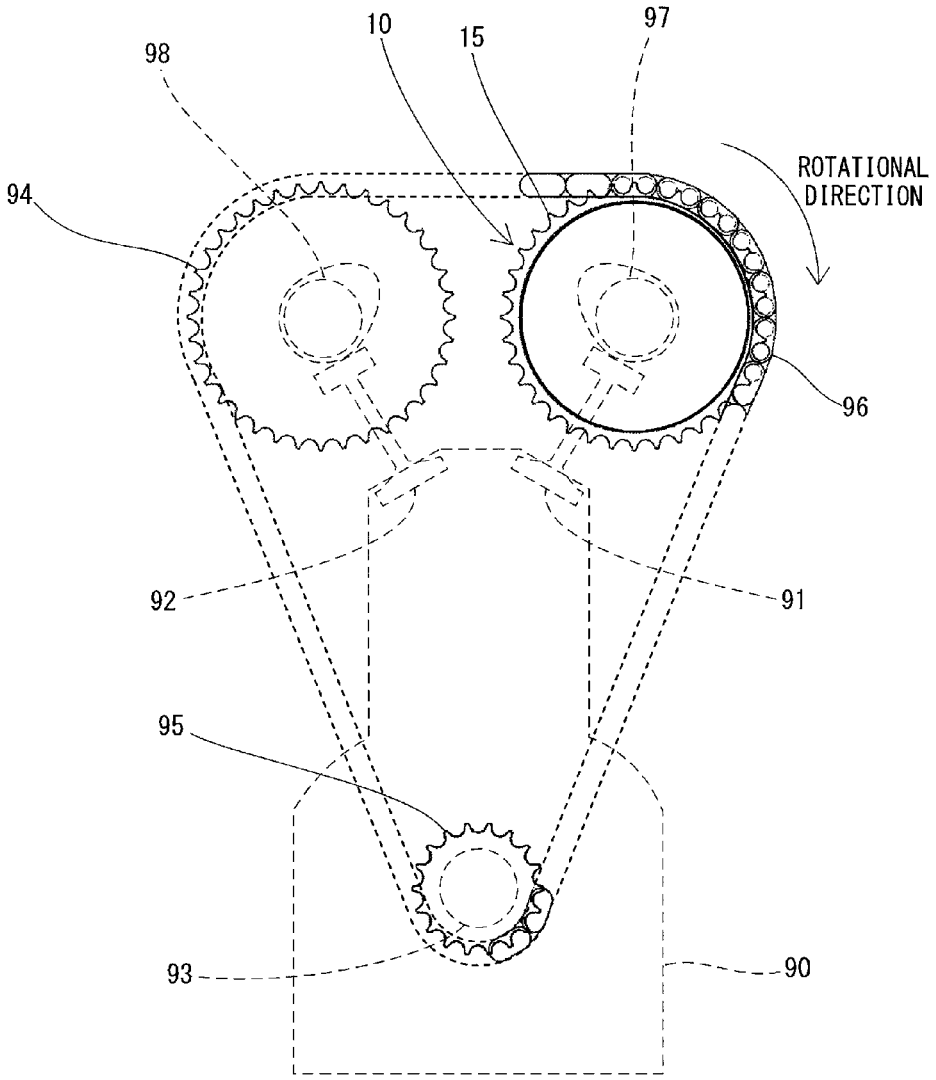
FIG. 2 is a schematic view showing an internal combustion engine, to which the valve timing adjusting system of FIG. 1 is applied.
Figure 3:
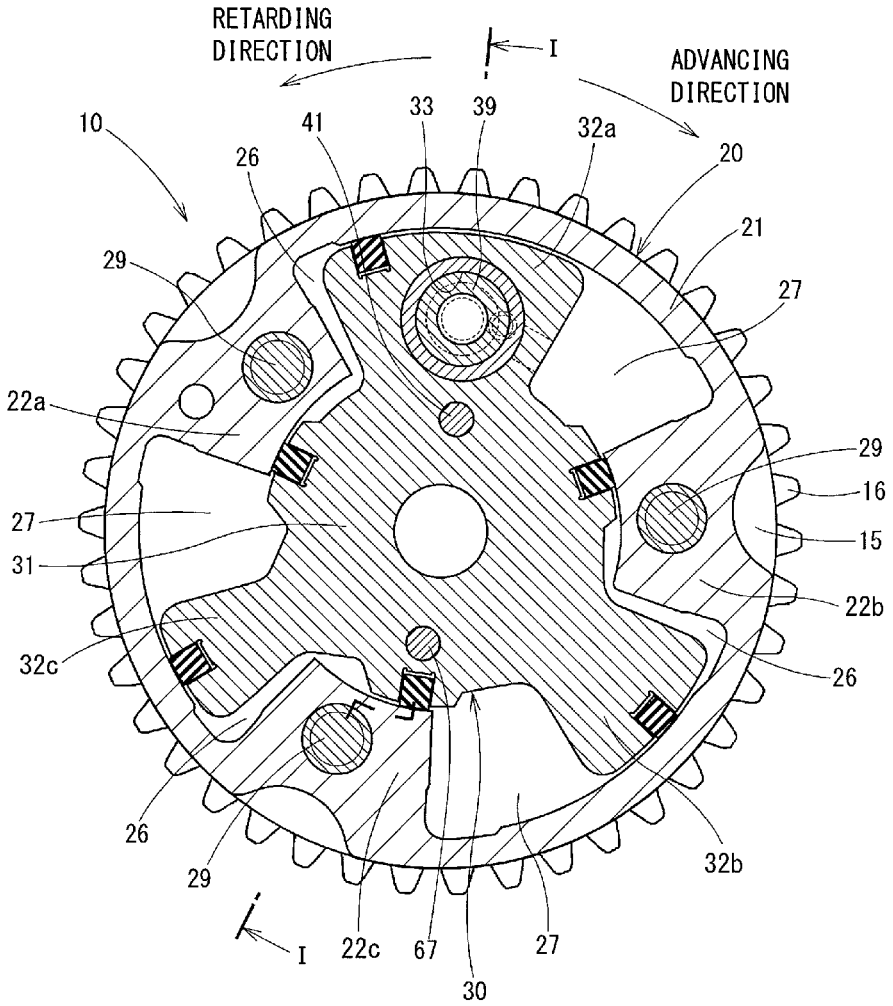
FIG. 3 is a schematic cross sectional view, taken along a line III-III in FIG. 1, showing a valve timing adjusting device of FIG. 1.

A valve timing adjusting system 5 according to a first embodiment of the present disclosure is shown in FIG. 1. The valve timing adjusting system 5 adjusts a valve opening timing and a valve closing timing of an intake valve 91 of an internal combustion engine 90 (hereinafter, the engine 90) shown in FIG. 2. As shown in FIG. 2, rotation of a crankshaft 93 of the engine 90 (a driving shaft 93 of the engine 90) is transmitted to cam shafts 97 and 98 via a chain 96, which is looped around sprockets 15, 94 and 95. The cam shaft 97 is a driven shaft of the engine 90 for opening and closing the intake valve 91, while the cam shaft 98 is a driven shaft for opening and closing an exhaust valve 92.

A valve timing adjusting device 10 rotates the cam shaft 97 in a rotating direction relative to the sprocket 15, which is integrally rotated with the crankshaft 93, so that a valve opening timing and/or a valve closing timing (hereinafter, collectively the valve opening/closing timing) for the intake valve 91 is shifted to an earlier timing. An operation for the cam shaft 97, in which the cam shaft 97 is relatively rotated in order to shift the valve opening/closing timing of the intake valve 91 to the earlier timing, is referred to as an operation that the cam shaft is advanced.

On the other hand, the valve timing adjusting device 10 rotates the cam shaft 97 in a direction opposite to the rotating direction relative to the sprocket 15, so that the valve opening/closing timing for the intake valve 91 is shifted to a later timing. An operation for the cam shaft 97, in which the cam shaft 97 is relatively rotated in order to shift the valve opening/closing timing of the intake valve 91 to the later timing, is referred to as an operation that the cam shaft is retarded.

A structure of the valve timing adjusting system 5 will be explained with reference to FIGS. 1 to 5. The valve timing adjusting system is composed of the valve timing adjusting device 10, an oil pressure control valve 70 and an electronic control unit 75 (hereinafter, the ECU 75).

The valve timing adjusting device 10 has the sprocket 15, a cup-shaped housing member 20, a vane rotor 30, a lock pin 39, a main angle-limiting mechanism 40 and an auxiliary angle-limiting mechanism 60. The sprocket 15 and the cup-shaped housing member 20 are collectively referred to as a housing.

The sprocket 15 has external gear teeth 16, around which the chain 96 is looped as shown in FIG. 2. The sprocket 15 has a bore 17, into which an axial end of the cam shaft 97 is movably inserted.

The cup-shaped housing member 20 has an outer housing portion 21 and multiple partitioning portions 22*a* to 22*c*. The outer housing portion 21 having a bottom wall 24 is coaxially arranged with the sprocket 15. Each of the partitioning portions 22*a* to 22*c* extends from a cylindrical wall 23 of the outer housing portion 21 in a radial-inward direction in order to define multiple oil pressure chambers together with the outer housing portion 21 and the sprocket 15. The cup-shaped housing member 20 is fixed to the sprocket 15 by multiple bolts 29, so that the cup-shaped housing member 20 is rotated together with the sprocket 15 and the cam shaft 97.

The vane rotor 30 has a boss portion 31 and multiple vanes 32*a* to 32*c*. The boss portion 31 is formed in a cylindrical shape and located in a radial-inside space of the partitioning portions 22*a* to 22*c*. The boss portion 31 is coaxially arranged with the sprocket 15. The boss portion 31 is fixed to the cam shaft 97 by a sleeve bolt (not shown), so that the boss portion 31 is integrally rotated with cam shaft 97.

Each of the vanes 32*a* to 32*c* extends from the boss portion 31 in a radial fashion, to thereby divide the oil pressure chamber (each defined by the boss portion 31, the cup-shaped housing member 20 and the sprocket 15) into an advancing chamber 26 and a retarding chamber 27.

The vane rotor 30 has an advancing oil passage 34 communicated to the advancing chamber 26 and a retarding oil passage 35 communicated to the retarding chamber 27. The vane rotor 30 is rotatable relative to the cup-shaped housing member 20 in an advancing direction or a retarding direction, depending on a pressure difference between working fluid pressure in the advancing chamber 26 and working fluid pressure in the retarding chamber 27.

Supposing that the main angle-limiting mechanism 40 and the auxiliary angle-limiting mechanism 60 do not work, the vane rotor 30 is rotatable relative to the cup-shaped housing member 20 within a predetermined angular range from a most retarded position to a most advanced position. In the most retarded position, one of the vanes 32*a* to 32*c* (for example, the vane 32*a*, which is hereinafter referred to as the specific vane 32*a*) is in contact with one of the partitioning portions 22*a* to 22*c* (for example, the partitioning portion 22*a*, which is hereinafter referred to as the specific partitioning portion 22*a*). In the most advanced position, the specific vane 32*a* is in contact with another specific partitioning portion 22*b*.

The specific vane 32*a* of the vane rotor 30 has a sliding bore 33 for movably accommodating the lock pin 39, so that the lock pin 39 slides in an axial direction of the lock pin 39. A fitting bore 25 is formed in the bottom wall 24 of the cup-shaped housing member 20. When the lock pin 39 is inserted into the fitting bore 25, as shown in FIG. 1, a relative movement between the vane rotor 30 and the cup-shaped housing member 20 is prohibited. In the present embodiment, as explained below, the fitting bore 25 is formed at a position corresponding to the most retarded position.

Figure 4:
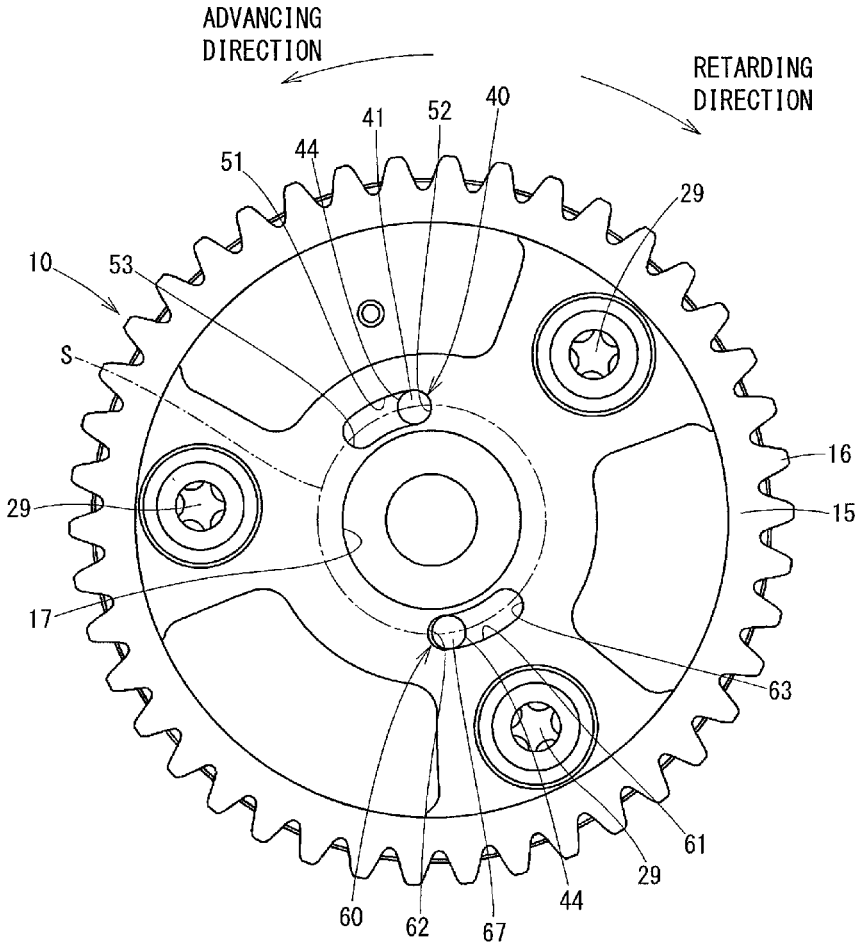
FIG. 4 is a schematic front-side view showing the valve timing adjusting device of FIG. 1, when viewed in a direction of an arrow IV in FIG. 1.
Figure 5:
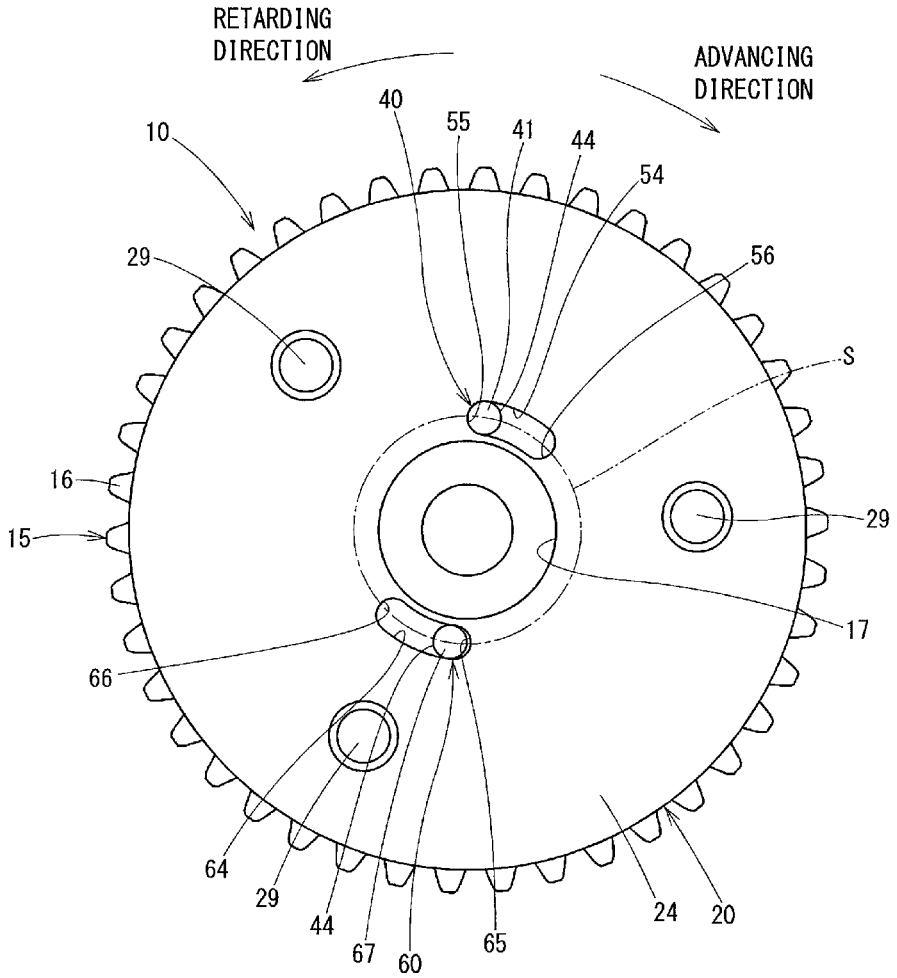
FIG. 5 is a schematic back-side view showing the valve timing adjusting device of FIG. 1, when viewed in a direction of an arrow V in FIG. 1.

The main angle-limiting mechanism 40 is composed of a main stopper pin 41 and main stopper surfaces 52, 53, 55 and 56, as shown in FIGS. 1, 4 and 5.

The main stopper pin 41 extends in an axial direction of the boss portion 31 of the vane rotor 30 and penetrates the boss portion 31. One axial end 42 (a first axial end 42) of the main stopper pin 41 projects into the sprocket 15, while the other axial end 43 (a second axial end 43) projects into the bottom wall 24 of the cup-shaped housing member 20. The main stopper pin 41 is formed in a columnar shape and has a cylindrical outer surface 44. In the present embodiment, one main stopper pin 41 is provided in the vane rotor 30.

As shown in FIG. 4, an arc-like groove 51 (a first groove 51) is formed in the sprocket 15. The arc-like groove 51 extends in a circumferential direction of the sprocket 15 along a virtual circle S, which is concentric to the boss portion 31 of the vane rotor 30. The main stopper surfaces 52 and 53 are circumferential end surfaces of the arc-like groove 51. The main stopper surface 52 corresponds to the circumferential end surface of the arc-like groove 51 on a retarding side. The main stopper surface 53 corresponds to the circumferential end surface of the arc-like groove 51 on an advancing side. Each of the main stopper surfaces 52 and 53 is formed in a curved concave surface, which is brought into contact with the first axial end 42 of the main stopper pin 41 in the circumferential direction.

As shown in FIG. 5, an arc-like groove 54 (a second groove 54) is formed in the bottom wall 24 of the cup-shaped housing member 20. The arc-like groove 54 extends in a circumferential direction of the bottom wall 24 along the virtual circle S. The main stopper surfaces 55 and 56 are circumferential end surfaces of the arc-like groove 54. The main stopper surface 55 corresponds to the circumferential end surface of the arc-like groove 54 on the retarding side. The main stopper surface 56 corresponds to the circumferential end surface of the arc-like groove 54 on the advancing side. Each of the main stopper surfaces 55 and 56 is formed in a curved concave surface, which is brought into contact with the second axial end 43 of the main stopper pin 41 in the circumferential direction.

Each of the main stopper pin 41, the sprocket 15 and the cup-shaped housing member 20 is made of metal, hardness of which is increased by a heat treatment, such as a quenching process. In addition, the main stopper pin 41 as well as inner surfaces of the arc-like grooves 51 and 54 is subjected to a surface treatment in order to improve abrasion resistance. The above surface treatment is, for example, plating, vapor deposition, printing, painting or the like.

When the first axial end 42 of the main stopper pin 41 is brought into contact with the main stopper surface 52 and the second axial end 43 of the main stopper pin 41 is brought into contact with the main stopper surface 55, the main angle-limiting mechanism 40 restricts the movement of the vane rotor 30 relative to the cup-shaped housing member 20 at the most retarded position. On the other hand, when the first axial end 42 of the main stopper pin 41 is brought into contact with the main stopper surface 53 and the second axial end 43 of the main stopper pin 41 is brought into contact with the main stopper surface 56, the main angle-limiting mechanism 40 restricts the movement of the vane rotor 30 relative to the cup-shaped housing member 20 at the most advanced position.

The main angle-limiting mechanism 40 mechanically restricts the movement of the vane rotor 30 relative to the cup-shaped housing member 20, so that a rotational phase difference between the vane rotor 30 and the cup-shaped housing member 20 is controlled at a value, which is within a main angular range smaller than the predetermined angular range.

The auxiliary angle-limiting mechanism 60 is composed of an auxiliary stopper pin 67 and auxiliary stopper surfaces 62, 63, 65 and 66, as shown in FIGS. 1, 4 and 5.

The auxiliary stopper pin 67 extends in the axial direction of the boss portion 31 of the vane rotor 30 and penetrates the boss portion 31. One axial end 68 (a first axial end 68) of the auxiliary stopper pin 67 projects into the sprocket 15, while the other axial end 69 (a second axial end 69) projects into the bottom wall 24 of the cup-shaped housing member 20. The auxiliary stopper pin 67 is formed in a columnar shape and has a cylindrical outer surface 44. In the present embodiment, one auxiliary stopper pin 67 is provided in the vane rotor 30.

As shown in FIG. 4, an arc-like groove 61 is formed in the sprocket 15 for the auxiliary angle-limiting mechanism 60. The arc-like groove 61 (the first groove 61) extends in the circumferential direction of the sprocket 15 along the virtual circle S, which is concentric to the boss portion 31 of the vane rotor 30. The auxiliary stopper surfaces 62 and 63 are circumferential end surfaces of the first groove 61. The auxiliary stopper surface 62 corresponds to the circumferential end surface of the first groove 61 on the retarding side. The auxiliary stopper surface 63 corresponds to the circumferential end surface of the first groove 61 on the advancing side. Each of the auxiliary stopper surfaces 62 and 63 is formed in a curved concave surface, which is brought into contact with the first axial end 68 of the auxiliary stopper pin 67 in the circumferential direction.

As shown in FIG. 5, another arc-like groove 64 (a second groove 64) is formed in the bottom wall 24 of the cup-shaped housing member 20. The second groove 64 extends in the circumferential direction of the bottom wall 24 along the virtual circle S. The auxiliary stopper surfaces 65 and 66 are circumferential end surfaces of the second groove 64. The auxiliary stopper surface 65 corresponds to the circumferential end surface of the second groove 64 on the retarding side. The auxiliary stopper surface 66 corresponds to the circumferential end surface of the second groove 64 on the advancing side. Each of the auxiliary stopper surfaces 65 and 66 is formed in a curved concave surface, which is brought into contact with the second axial end 69 of the auxiliary stopper pin 67 in the circumferential direction.

The auxiliary stopper pin 67 is made of metal, hardness of which is increased by the heat treatment, such as the quenching process. In addition, the auxiliary stopper pin 67 as well as inner surfaces of the arc-like first and second grooves 61 and 64 is subjected to the surface treatment in order to improve abrasion resistance. The above surface treatment is, for example, plating, vapor deposition, printing, painting or the like.

When the first axial end 68 of the auxiliary stopper pin 67 is brought into contact with the auxiliary stopper surface 62 and the second axial end 69 of the auxiliary stopper pin 67 is brought into contact with the auxiliary stopper surface 65, the auxiliary angle-limiting mechanism 60 restricts the movement of the vane rotor 30 relative to the cup-shaped housing member 20 in the retarding direction. On the other hand, when the first axial end 68 of the auxiliary stopper pin 67 is brought into contact with the auxiliary stopper surface 63 and the second axial end 69 of the auxiliary stopper pin 67 is brought into contact with the auxiliary stopper surface 66, the auxiliary angle-limiting mechanism 60 restricts the movement of the vane rotor 30 relative to the cup-shaped housing member 20 in the advancing direction.

The auxiliary angle-limiting mechanism 60 mechanically restricts the movement of the vane rotor 30 relative to the cup-shaped housing member 20, so that the rotational phase difference between the vane rotor 30 and the cup-shaped housing member 20 is controlled at a value, which is within an auxiliary angular range larger than the main angular range but smaller than the predetermined angular range. More exactly, a circumferential length of each arc-like groove 61 and 64 of the auxiliary angle-limiting mechanism 60 is made to be slightly larger than that of the arc-like first and second grooves 51 and 54 of the main angle-limiting mechanism 40. The engine 90 is so designed that the intake valve 91 does not interfere with the other engine parts (such as, the piston and so on) and abnormal combustion does not take place, when the rotational phase difference is within the auxiliary angular range.

The oil pressure control valve 70 has three operational positions, that is, an advancing position, a retarding position and a block-off position. In the advancing position, the oil pressure control valve 70 connects a discharge port of an oil pump 71 to the advancing oil passage 34 and connects the retarding oil passage 35 to an oil pooling portion of an oil pan 72. In the retarding position, the oil pressure control valve 70 connects the discharge port of the oil pump 71 to the retarding oil passage 35 and connects the advancing oil passage 34 to the oil pooling portion of the oil pan 72. In the block-off position, the oil pressure control valve 70 blocks off the advancing oil passage 34 and the retarding oil passage 35 from the outside of the valve timing adjusting device 10.

When the oil pressure control valve 70 is in the advancing position, working fluid (the working oil) pumped up by the oil pump 71 is supplied to the advancing chamber 26, while the working oil is discharged from the retarding chamber 27 to the oil pan 72. On the other hand, when the oil pressure control valve 70 is in the retarding position, the working oil pumped up by the oil pump 71 is supplied to the retarding chamber 27, while the working oil is discharged from the advancing chamber 26 to the oil pan 72. As above, the oil pressure control valve 70 controls the oil pressure in the advancing and retarding chambers 26 and 27 depending on the operational position thereof, in order to adjust the rotational phase difference.

The ECU 75 is composed of a micro-computer having a CPU, a ROM, a RAM, an input-output device and so on. Those components are not shown in the drawing. The ECU 75 receives various kinds of detection signals from a sensor 76 for engine rotational speed, a sensor 77 for intake air amount, a sensor 78 for a crank angle (a crank-angle sensor 78), a sensor 79 for a cam angle (a cam-angle sensor 79) and so on. The sensor detects the engine rotational speed "Ne". The sensor 77 detects the intake air amount "Gn". The crank-angle sensor 78 detects the crank angle "θcr", which is a rotational angle of the crankshaft 93. The cam-angle sensor 79 detects the cam angle "θcam", which is a rotational angle of the camshaft 97. Each of resolution capabilities of the crank-angle sensor 78 and the cam-angle sensor 79 is smaller than either one of a difference between the predetermined angular range and the auxiliary angular range and a difference between the auxiliary angular range and the main angular range. The ECU 75 processes the detection signals from the sensors 76 to 79 in accordance with control programs memorized in a memory device thereof, in order to calculate a control amount for the oil pressure control valve 70 to thereby carry out a valve timing control.

More exactly, the ECU 75 calculates the rotational phase difference based on the crank angle "θcr" and the cam angle "θcam". The ECU 75, the crank-angle sensor 78 and the cam-angle sensor 79 are collectively referred to as an angular-position detecting device.

The ECU 75 determines whether the above calculated rotational phase difference is out of the main angular range or not. In a case that the above determination is positive, it means that the main angle-limiting mechanism 40 does not function. Namely, it means that the main angle-limiting mechanism 40 is broken. For example, it means that the main stopper pin 41 is broken or deformed. The ECU 75 functions as an abnormal condition detecting device.

The ECU 75 sets a target value for the rotational phase difference (hereinafter, the target rotational phase difference) based on a map for a normal vehicle travel and a map for a retreat vehicle travel, each of which is stored in the memory device of the ECU 75. The map for the normal vehicle travel as well as the map for the retreat vehicle travel is a map, in which the engine rotational speed "Ne" and the intake air amount "Gn" are used as parameters, among other parameters for indicating the engine operational conditions. In the maps, the target rotational phase differences are given to each of grid points, which are set at a predetermined pitch.

The map for the normal vehicle travel is used when the calculated rotational phase difference is not out of the main angular range, namely when the main angle-limiting mechanism 40 is not broken. The ECU 75 sets the target rotational phase difference at a value within the main angular range based on the map for the normal vehicle travel, when the ECU 75 determines that the calculated rotational phase difference is not out of the main angular range.

The map for the retreat vehicle travel is used when the calculated rotational phase difference is out of the main angular range, namely when the main angle-limiting mechanism 40 is broken. The ECU 75 sets the target rotational phase difference at a value within a restricted angular range, which is smaller than the main angular range, based on the map for the retreat vehicle travel, when the ECU 75 determines that the calculated rotational phase difference is out of the main angular range. The ECU 75 also functions as a target-value setting device.

The ECU 75 drives the oil pressure control valve 70 so that the calculated rotational phase difference coincides with the target value for the rotational phase difference. Namely, the ECU 75 feedback controls the valve timing adjusting device 10. The ECU 75 also functions as a valve driving device.

Figure 6:
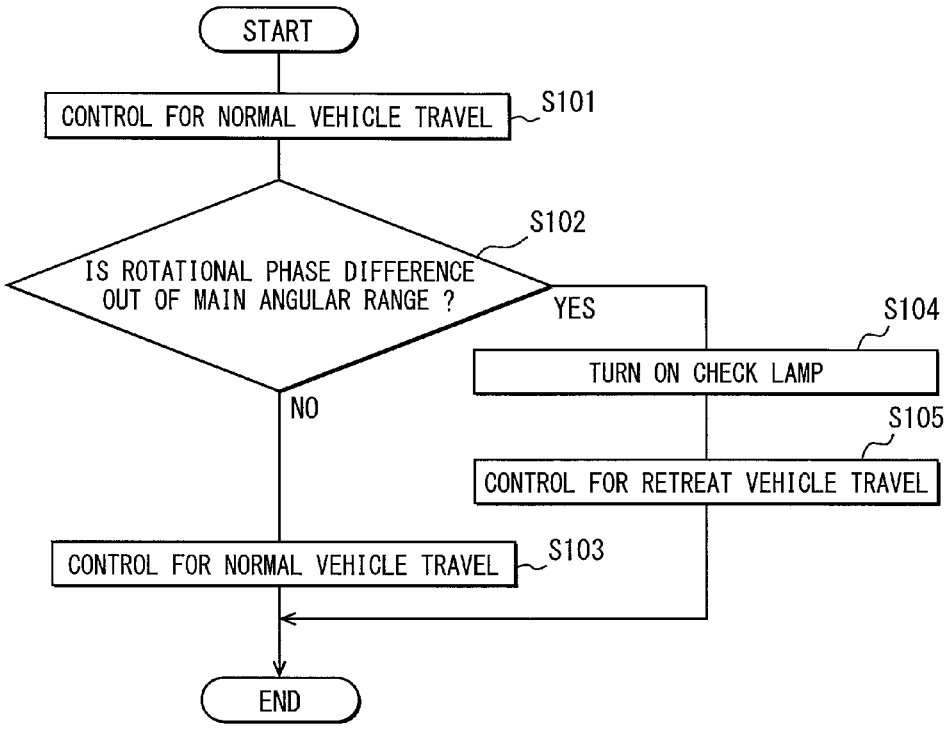
FIG. 6 is a flowchart showing a control routine carried out by an electronic control unit for controlling the valve timing adjusting system of FIG. 1.
Figure 7:
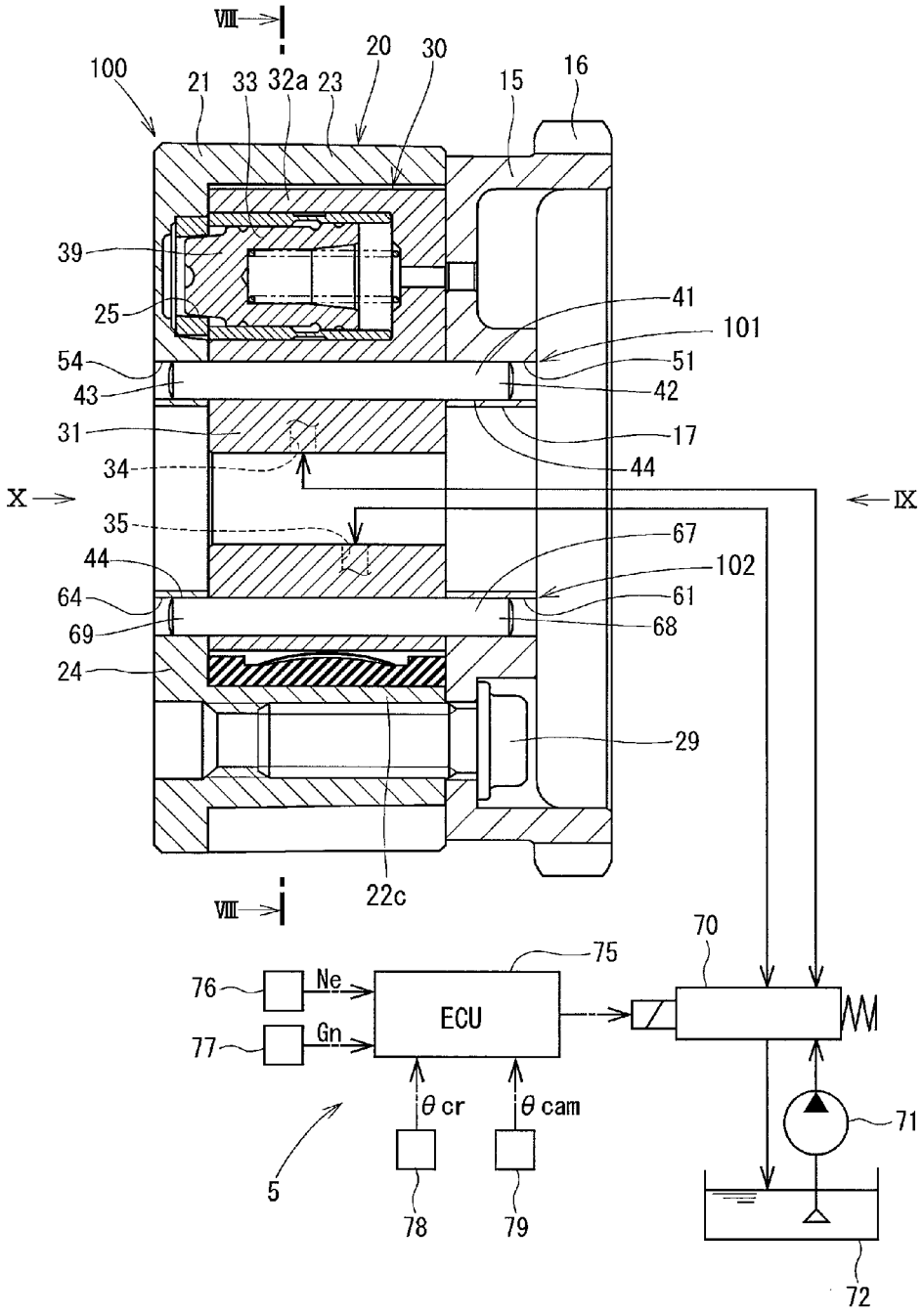
FIG. 7 is a view showing a structure of a valve timing adjusting system according to a second embodiment of the present disclosure.
Figure 8:
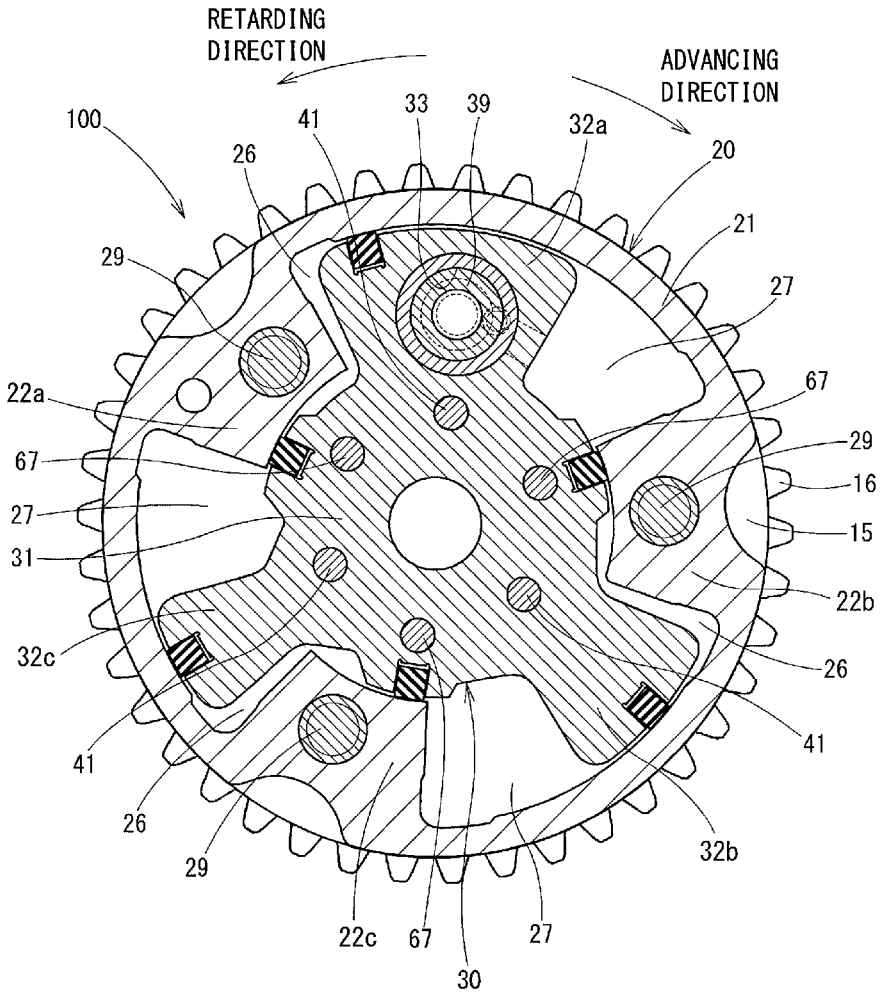
FIG. 8 is a cross sectional view, taken along a line VIII-VIII in FIG. 7, showing a valve timing adjusting device of the second embodiment.
Figure 9:
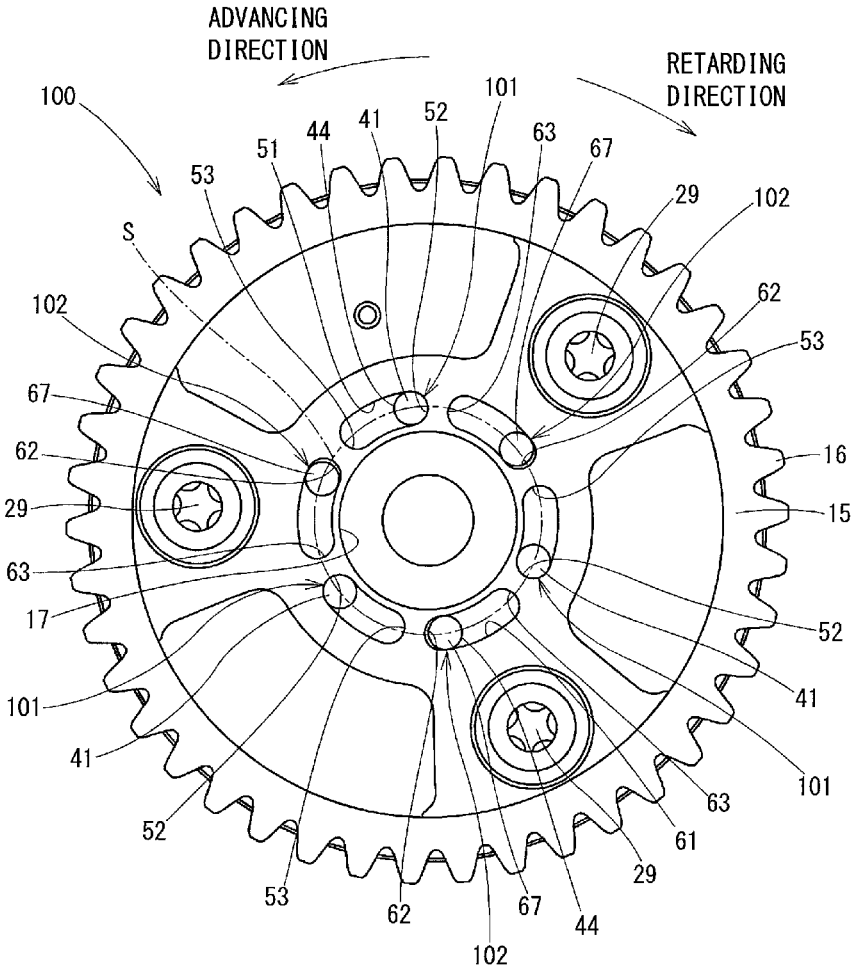
FIG. 9 is a schematic front-side view showing the valve timing adjusting device of FIG. 7, when viewed in a direction of an arrow IX in FIG. 7.
Figure 10:
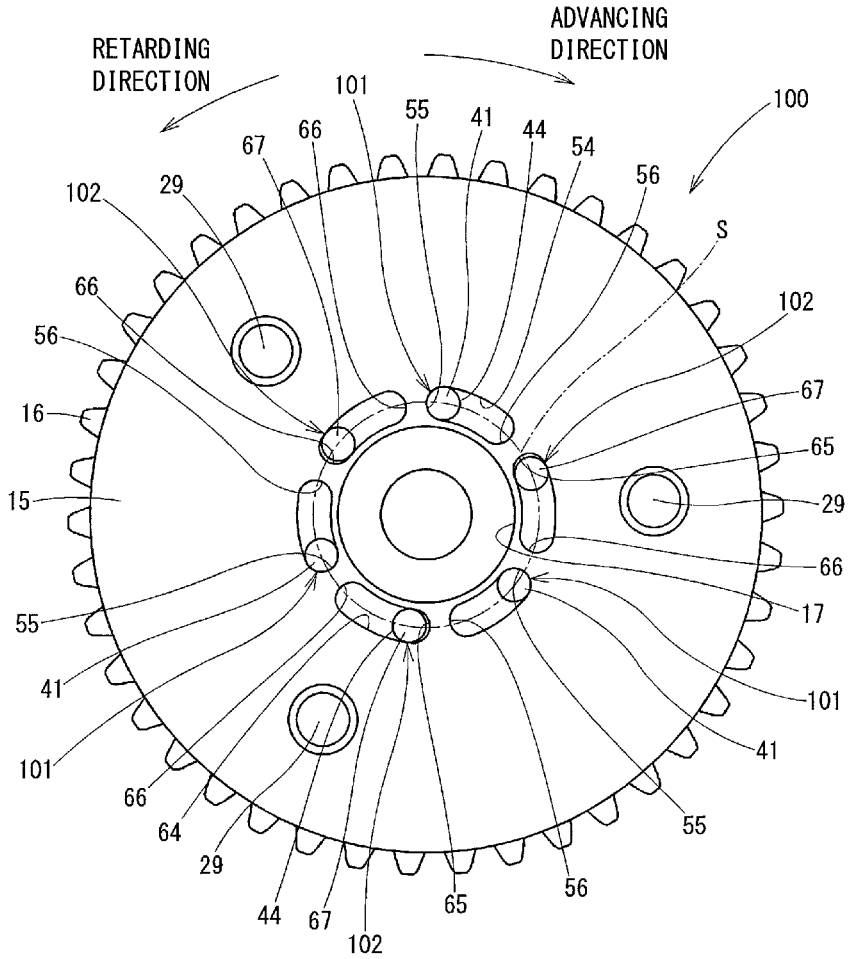
FIG. 10 is a schematic back-side view showing the valve timing adjusting device of FIG. 7, when viewed in a direction of an arrow X in FIG. 7.

A valve timing control carried out by the ECU 75 will be explained with reference to a flowchart of FIG. 6 showing a routine for the valve timing control. The above routine is repeatedly carried out at a predetermined time interval during a period from starting the operation of the engine to stopping the engine operation. The various kinds of parameters, which are used in the following process are memorized in the memory device, for example, in the RAM, and renewed from time to time according to necessity.

At a step S101, the ECU 75 carries out the control for the normal vehicle travel. In the control for the normal vehicle travel, the ECU 75 calculates the rotational phase difference based on the crank angle "θcr" and the cam angle "θcam" and sets the target rotational phase difference based on the map for the normal vehicle travel. The target rotational phase difference is set at the value, which is within the main angular range. Then, the ECU 75 drives the oil pressure control valve 70 so that the calculated rotational phase difference coincides with the target rotational phase difference.

At a step S102, the ECU 75 determines whether the calculated rotational phase difference is out of the main angular range or not. When the determination at the step S102 is negative (namely, NO at the step S102), the process goes to a step S103. When the determination at the step S102 is positive (namely, YES at the step S102), the process goes to a step S104.

The step S102 is also referred to as an abnormal condition detecting portion.

At the step S103, the ECU 75 carries out the control for the normal vehicle travel, which is the same to the control at the step S101. The process goes from the step S103 to an end, to terminate the process of FIG. 6.

At the step S104, the ECU 75 operates a check lamp (not shown) provided in an instrument panel of the vehicle to turn on the check lamp.

At a step S105, the ECU 75 carries out the control for the retreat vehicle travel. In the control for the retreat vehicle travel, the ECU 75 calculates the rotational phase difference based on the crank angle "θcr" and the cam angle "θcam" and sets the target rotational phase difference based on the map for the retreat vehicle travel. The target rotational phase difference is set at the value, which is within the restricted angular range. Then, the ECU 75 drives the oil pressure control valve 70 so that the calculated rotational phase difference coincides with the target rotational phase difference. The process goes from the step S105 to the end, to terminate the process of FIG. 6.

The step S105 is also referred to as a target-value setting portion. The steps S101, S103 and S105 are collectively referred to as a valve driving portion.

As explained above, according to the valve timing adjusting system 5 of the first embodiment, the relative movement between the vane rotor 30 and the cup-shaped housing member 20 is mechanically limited by the main angle-limiting mechanism 40, so that the rotational phase difference is adjusted within the main angular range. When the ECU 75 determines that the calculated rotational phase difference is out of the main angular range, the ECU 75 sets the target rotational phase difference at the value, which is within the restricted angular range smaller than the main angular range.

Accordingly, in the case that the rotational phase difference between the vane rotor 30 and the cup-shaped housing member 20 becomes out of the main angular range, for example, as a result that the main angle-limiting mechanism 40 is broken, the ECU 75 immediately controls the rotational phase difference at the value, which is within the restricted angular range smaller than the main angular range. It is, therefore, possible to prevent a possible damage of the engine 90, which may be caused by the rotational phase difference becoming out of the main angular range.

In addition, according to the first embodiment, the auxiliary angle-limiting mechanism 60 is provided. The auxiliary angle-limiting mechanism 60 mechanically limits the relative movement between the vane rotor 30 and the cup-shaped housing member 20, so that the rotational phase difference is controlled at the value, which is within the auxiliary angular range larger than the main angular range but smaller than the predetermined angular range. The auxiliary angular range is so set as such a range that the intake valve 91 of the engine 90 does not interfere with the other engine parts (such as, the piston or the like) and that abnormal combustion does not occur, so long as the rotational phase difference is within the auxiliary angular range.

Accordingly, even when the main angle-limiting mechanism 40 was broken and thereby the rotational phase difference was out of the main angular range, the auxiliary angle-limiting mechanism 60 avoids a situation that the intake valve 91 of the engine 90 interferes with the other engine parts (such as, the piston or the like) and the abnormal combustion occurs in the engine 90.

In addition, according to the first embodiment, the auxiliary angle-limiting mechanism 60 is composed of; the auxiliary stopper pin 67 penetrating the boss portion 31 of the vane rotor 30 in the axial direction thereof; the auxiliary stopper surfaces 62 and 63, with which the first axial end 68 of the auxiliary stopper pin 67 is brought into contact in the circumferential direction; and the auxiliary stopper surfaces 65 and 66, with which the second axial end 69 of the auxiliary stopper pin 67 is brought into contact in the circumferential direction.

The auxiliary stopper pin 67 is formed in the columnar shape so as to have the cylindrical outer surface 44. Each of the auxiliary stopper surfaces 62, 63, 65 and 66 is formed in the curved concave surface, which is brought into contact with the cylindrical outer surface 44 of the auxiliary stopper pin 67. Accordingly, contacting portions between the auxiliary stopper pin 67 and the auxiliary stopper surfaces 62, 63, 65 and 66 are stabilized to decrease stress applied from one to the other.

In addition, according to the first embodiment, the auxiliary stopper pin 67, the sprocket 15 and the cup-shaped housing member 20 are subjected to the heat treatment in order to increase the hardness thereof. It is, therefore, possible to suppress a possible deformation of each of the above elements, which may be caused by impact occurring when the auxiliary stopper pin 67 is brought into contact with the auxiliary stopper surfaces 62, 63, 65 and 66. In addition, the abrasion resistance can be likewise increased.

Furthermore, according to the first embodiment, the outer surface of the auxiliary stopper pin 67, the inner wall surface of the arc-like groove 61 in which the auxiliary stopper surfaces 62 and 63 are formed, and the inner wall surface of the arc-like groove 64 in which the auxiliary stopper surfaces 65 and 66 are formed are subjected to the surface treatment. As a result, the abrasion resistance of the auxiliary stopper pin 67 and the auxiliary stopper surfaces 62, 63, 65 and 66 can be further increased.

Second Embodiment

A valve timing adjusting device 100 of a second embodiment will be explained with reference to FIGS. 7 to 10.

A main angle-limiting mechanism 101 of the valve timing adjusting device 100 has three units of the mechanism 101, each having the main stopper pin 41 and the main arc-like groove 51, which are identical to those of the first embodiment. The main stopper pins 41 and the main arc-like grooves 51 are arranged in the vane rotor 30 at equal intervals in the circumferential direction.

An auxiliary angle-limiting mechanism 102 of the valve timing adjusting device 100 has three units of the mechanism 102, each having the auxiliary stopper pin 67 and the auxiliary arc-like groove 61, which are identical to those of the first embodiment. The auxiliary stopper pins 67 and the auxiliary arc-like grooves 61 are arranged in the vane rotor 30 at equal intervals in the circumferential direction.

According to the second embodiment, the impact force applied to the vane rotor 30 is diverged equally in the circumferential direction, when the relative movement of the vane rotor 30 is limited by the main angle-limiting mechanism 101 or the auxiliary angle-limiting mechanism 102.

Third Embodiment

Figure 11:
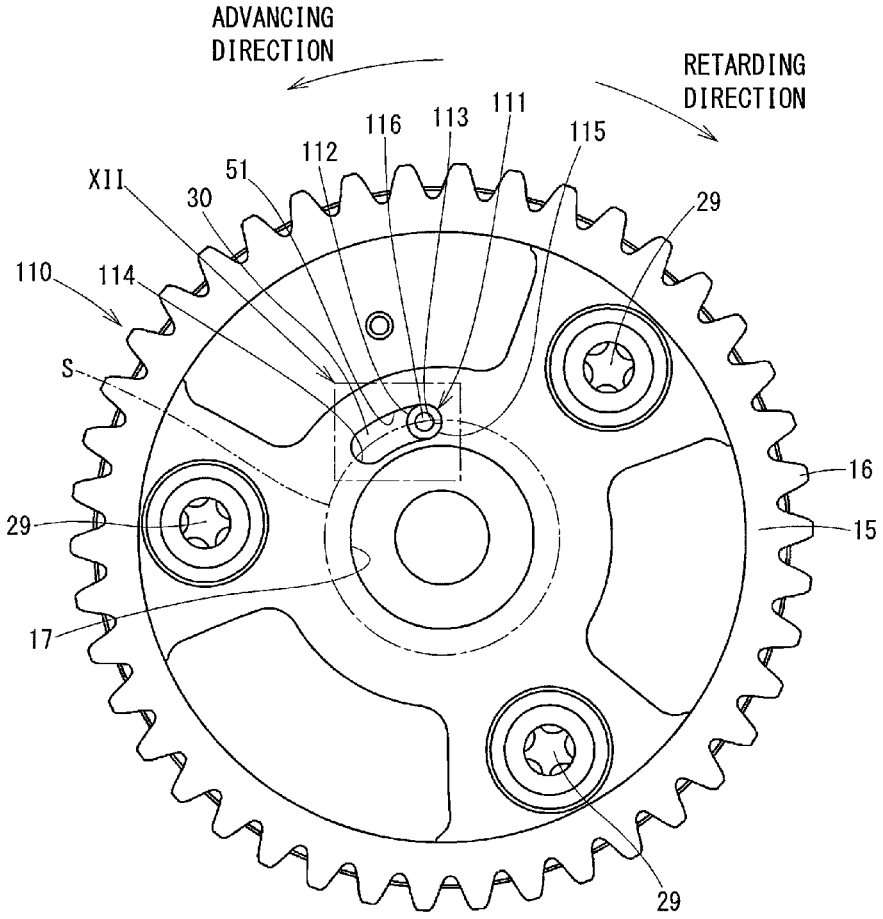
FIG. 11 is a schematic front-side view showing a valve timing adjusting device according to a third embodiment of the present disclosure, when viewed from a side of a sprocket.
Figure 12:
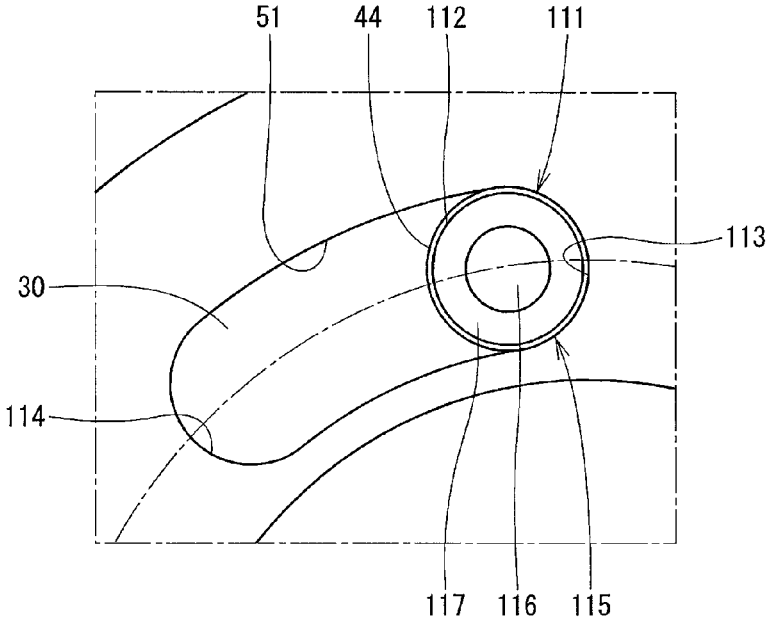
FIG. 12 is a schematic enlarged view showing relevant portions encircled by a dotted line XII in FIG. 11.

A valve timing adjusting device 110 of a third embodiment will be explained with reference to FIGS. 11 to 13.

A main angle-limiting mechanism 111 of the valve timing adjusting device 110 is composed of a main stopper pin 112 and stopper surfaces 113 and 114. The main stopper pin 112 is made of metal and formed in a tubular shape. The main stopper pin 112 projects from the vane rotor 30 into the sprocket 15. The stopper surfaces 113 and 114 are end surfaces of the arc-like groove 51 in the circumferential direction. The stopper surface 113 is the end surface on the retarding side, while the stopper surface 114 is the end surface on the advancing side. Each of the stopper surfaces 113 and 114 is formed by the curved concave surface, with which the main stopper pin 112 is brought into contact in the circumferential direction.

The main angle-limiting mechanism 111 limits the relative movement of the vane rotor 30 to the sprocket 15 at the most retarded position, when the main stopper pin 112 is brought into contact with the stopper surface 113. In a similar manner, the main angle-limiting mechanism 111 limits the relative movement of the vane rotor 30 to the sprocket 15 at the most advanced position, when the main stopper pin 112 is brought into contact with the stopper surface 114. The main angle-limiting mechanism 111 mechanically limits the relative movement between the vane rotor 30 and the cup-shaped housing member, so that the rotational phase difference between the cup-shaped housing member and the vane rotor 30 is adjusted within the main angular range, which is smaller than the predetermined angular range.

An auxiliary angle-limiting mechanism 115 is composed of an auxiliary stopper pin 116 and the stopper surfaces 113 and 114. The auxiliary stopper pin 116 is made of metal and formed in a columnar shape. The auxiliary stopper pin 116 is coaxially arranged within the main stopper pin 112. The auxiliary stopper pin 116 projects from the vane rotor 30 into the sprocket 15. A shock-absorbing member 117 made of rubber is provided between the main stopper pin 112 and the auxiliary stopper pin 116.

Figure 13:
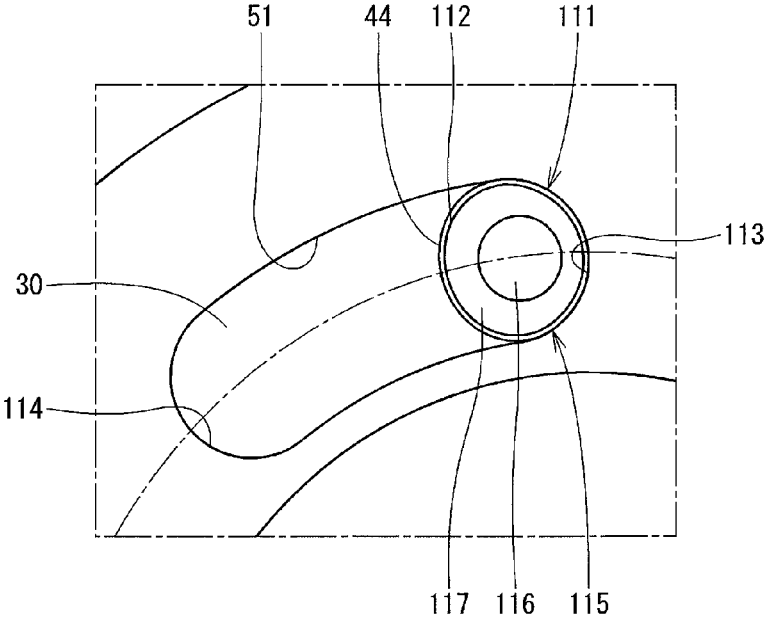
FIG. 13 is a schematic enlarged view corresponding to FIG. 12, showing a case that a stopper pin is deformed.

The auxiliary angle-limiting mechanism 115 limits the relative movement of the vane rotor 30 to the sprocket 15, when the main stopper pin 112 is deformed (for example, a relative distance between the main and the auxiliary stopper pins 112 and 116 is changed) as a result that an impact power larger than a predetermined value is applied to the main stopper pin 112, as shown in FIG. 13. The auxiliary angle-limiting mechanism 115 mechanically limits the relative movement between the vane rotor 30 and the sprocket 15, so that the rotational phase difference is adjusted within the auxiliary angular range, which is larger than the main angular range but smaller than the predetermined angular range.

Fourth Embodiment

Figure 14:
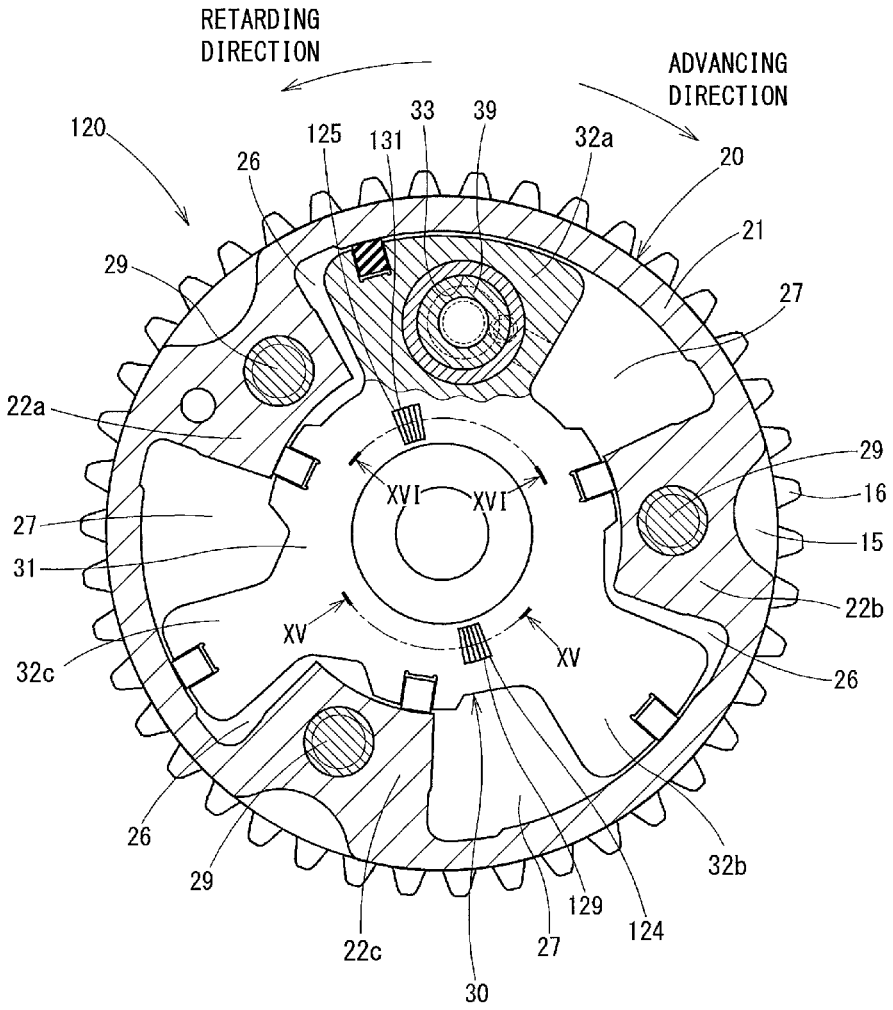
FIG. 14 is a schematic front-side view showing a valve timing adjusting device according to a fourth embodiment of the present disclosure.
Figure 15:
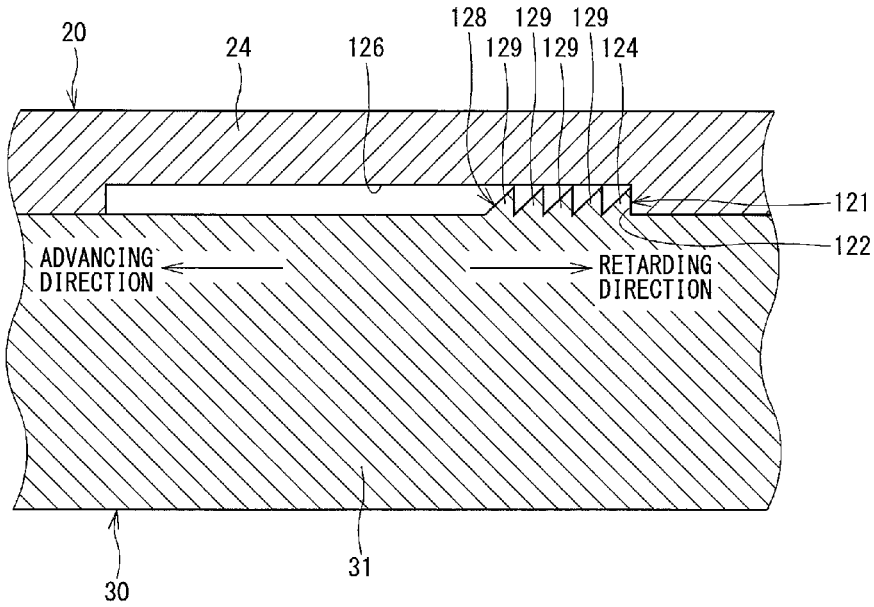
FIG. 15 is a schematic cross sectional view, taken along a line XV-XV in FIG. 14, showing a main angle-limiting mechanism.
Figure 16:
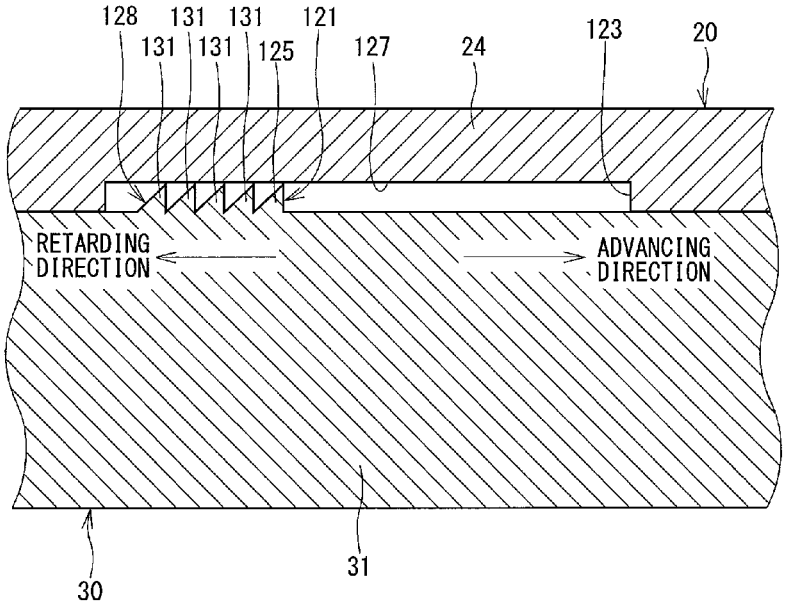
FIG. 16 is a schematic cross sectional view, taken along a line XVI-XVI in FIG. 14, showing an auxiliary angle-limiting mechanism.

A valve timing adjusting device 120 of a fourth embodiment will be explained with reference to FIGS. 14 to 16.

A main angle-limiting mechanism 121 of the valve timing adjusting device 120 is composed of stopper surfaces 122 and 123 and main stopper projections 124 and 125. The stopper surface 122 is an end surface of an arc-like groove 126 on the retarding side, wherein the arc-like groove 126 is formed in the bottom wall 24 of the cup-shaped housing member 20 and the arc-like groove 126 extends along the virtual circle S concentric to the boss portion 31 of the vane rotor 30. The main stopper projection 124 is a projection formed in the vane rotor 30, wherein the main stopper projection 124 projects from the boss portion 31 into the arc-like groove 126. The main stopper projection 124 is brought into contact with the stopper surface 122 in a surface contact manner.

The stopper surface 123 is an end surface of an arc-like groove 127 on the advancing side, wherein the arc-like groove 127 is formed in the bottom wall 24 of the cup-shaped housing member 20 and the arc-like groove 127 extends along the virtual circle S concentric to the boss portion 31 of the vane rotor 30. The main stopper projection 125 is a projection formed in the vane rotor 30, wherein the main stopper projection 125 projects from the boss portion 31 into the arc-like groove 127. The main stopper projection 125 is brought into contact with the stopper surface 123 in a surface contact manner.

The main angle-limiting mechanism 121 limits the relative movement of the vane rotor 30 to the cup-shaped housing member 20 at the most retarded position, when the main stopper projection 124 is brought into contact with the stopper surface 122. In a similar manner, the main angle-limiting mechanism 121 limits the relative movement of the vane rotor 30 to the cup-shaped housing member 20 at the most advanced position, when the main stopper projection 125 is brought into contact with the stopper surface 123. The main angle-limiting mechanism 121 mechanically limits the relative movement between the vane rotor 30 and the cup-shaped housing member 20, so that the rotational phase difference between the cup-shaped housing member 20 and the vane rotor 30 is adjusted within the main angular range, which is smaller than the predetermined angular range.

An auxiliary angle-limiting mechanism 128 is composed of the stopper surfaces 122 and 123 and multiple auxiliary stopper projections 129 and 131. Each of the auxiliary stopper projections 129 is integrally formed with the vane rotor 30 continuously from the main stopper projection 124 in the advancing direction. Each of the auxiliary stopper projections 131 is integrally formed with the vane rotor 30 continuously from the main stopper projection 125 in the retarding direction.

The auxiliary angle-limiting mechanism 128 limits the relative movement of the vane rotor 30 to the sprocket 15 in the retarding direction, when the main stopper projection 124 is broken due to an impact power larger than a predetermined value. In a similar manner, the auxiliary angle-limiting mechanism 128 limits the relative movement of the vane rotor 30 to the sprocket 15 in the advancing direction, when the main stopper projection 125 is broken due to an impact power larger than a predetermined value. The auxiliary angle-limiting mechanism 128 mechanically limits the relative movement between the vane rotor 30 and the sprocket 15, so that the rotational phase difference is adjusted within the auxiliary angular range, which is larger than the main angular range but smaller than the predetermined angular range. The fourth embodiment has the same advantages to the first embodiment.

Further Embodiments and/or Modifications

The above embodiments can be modified in the following manners:

The stopper pins may be integrally formed with the vane rotor.

The first axial end of the stopper pin may be made of a different part from the second axial end thereof.

The stopper pin may be formed on either one of axial side surfaces of the vane rotor.

The number of stopper pins may be equal to or more than two or four.

When the multiple stopper pins are provided, it is not always necessary to arrange them at equal intervals in the circumferential direction.

According to a further modification, the stopper pin may be formed or provided at the sprocket and the bottom wall of the cup-shaped housing member, while the stopper surface may be formed in the vane rotor.

According to a still further modification, the contacting surfaces between the stopper pin and the stopper surface should not be limited to the cylindrical outer surface and the curved concave surface. The contacting surfaces may be made of flat surfaces.

According to a still further modification, a part of or all of the stopper pin, the stopper surface and the cup-shaped housing member may be made of not the metal but resin. Hardness of the above parts or portions may not be necessarily increased by the thermal treatment.

According to a still further modification, it is not always necessary to carry out the surface treatment for the stopper pin and the inner wall surface of the arc-like groove.

According to a still further modification, in the map for the normal vehicle travel as well as the map for the retreat vehicle travel, other parameters than the engine rotational speed and the intake air amount may be used. For example, such a parameter indicating engine load may be used instead of the intake air amount.

According to a still further modification, the vane rotor may be made of a laminated body, which is composed of multiple metal sheets laminated in its thickness direction.

According to a still further modification, the housing member may be formed not in the cup shape but in a dome shape.

According to a still further modification, any rotational transmitting member other than the sprocket and the chain may be used.

According to a still further modification, the valve timing adjusting device may be also applied to the exhaust valve of the engine.

The present disclosure should not be limited to the above embodiments and/or the modifications but can be further modified in various manners without departing from the spirit of the present disclosure.

What is claimed is:

1. A valve timing adjusting system provided in a rotation transmitting system, in which rotation of an engine is transmitted from a driving shaft of the engine to a driven shaft for opening and closing an intake valve and/or an exhaust valve, for adjusting a valve opening/closing timing of the intake valve and/or the exhaust valve, comprising:

a housing rotated together with one of the driving shaft and the driven shaft;

a vane rotor rotatably accommodated in the housing and having a vane for forming an advancing chamber and a retarding chamber, the vane rotor being rotated together with the other one of the driving shaft and the driven shaft, and the vane rotor being rotatable relative to the housing within a predetermined angular range;

an oil pressure control valve for controlling oil pressure in the advancing chamber and oil pressure in the retarding chamber, to thereby adjust a rotational phase difference between the housing and the vane rotor;

an angular-position detecting device for detecting the rotational phase difference;

a main angle-limiting mechanism for mechanically limiting a relative movement between the housing and the vane rotor in order that the rotational phase difference is controlled at a value within a main angular range which is smaller than the predetermined angular range; and a control unit having an abnormal condition detecting portion for determining whether the rotational phase difference is out of the main angular range or not, the control unit having a target-value setting portion for setting a target value for the rotational phase difference when the control unit determines that the rotational phase difference is out of the main angular range, wherein the target value is set as such a value within a restricted angular range which is smaller than the main angular range, and the control unit further having a valve driving portion for controlling the oil pressure control valve in order that the rotational phase difference coincides with the target value.

2. The valve timing adjusting system according to claim 1, wherein the main angle-limiting mechanism comprises;

a main stopper pin passing through the vane rotor in its axial direction and projecting from the vane rotor into at least one of axial ends of the housing;

a groove formed at the axial end of the housing, into which one axial end of the main stopper pin projects; and main stopper surfaces formed at circumferential ends of the groove for defining the main angular range, wherein the main stopper pin is brought into contact with the main stopper surfaces in a circumferential direction of the groove, so that the rotational phase difference is controlled at the value within the main angular range.

3. The valve timing adjusting system according to claim 2, wherein the main angle-limiting mechanism has multiple main stopper pins, which are arranged at equal intervals in the circumferential direction of the vane rotor.

4. The valve timing adjusting system according to claim 2, wherein the main stopper pin has a cylindrical outer surface, and each of the main stopper surfaces has a curved concave surface, which is brought into contact with the cylindrical outer surface of the main stopper pin.

5. The valve timing adjusting system according to claim 2, wherein the main stopper pin and/or the main stopper surfaces are subjected to heat treatment.

6. The valve timing adjusting system according to claim 2, wherein the main stopper pin and/or the main stopper surfaces are subjected to surface treatment.

7. The valve timing adjusting system according to claim 1, further comprising;

an auxiliary angle-limiting mechanism for mechanically limiting the relative movement between the housing and the vane rotor in order that the rotational phase difference is controlled at a value within an auxiliary angular range, which is larger than the main angular range but smaller than the predetermined angular range.

8. The valve timing adjusting system according to claim 7, wherein the auxiliary angle-limiting mechanism comprises;

an auxiliary stopper pin passing through the vane rotor in its axial direction and projecting from the vane rotor into at least one of axial ends of the housing;

an auxiliary groove formed at the axial end of the housing, into which one axial end of the auxiliary stopper pin projects; and auxiliary stopper surfaces formed at circumferential ends of the auxiliary groove for defining the auxiliary angular range, wherein the auxiliary stopper pin is brought into contact with the auxiliary stopper surfaces in a circumferential direction, when the auxiliary angle-limiting mechanism works.

9. The valve timing adjusting system according to claim 8, wherein the auxiliary stopper pin has a cylindrical outer surface, and each of the auxiliary stopper surfaces has a curved concave surface, which is brought into contact with the cylindrical outer surface of the auxiliary stopper pin.

10. The valve timing adjusting system according to claim 8, wherein the auxiliary angle-limiting portion has multiple auxiliary stopper pins, which are arranged at equal intervals in the circumferential direction of the vane rotor.

11. The valve timing adjusting system according to claim 8, wherein the auxiliary stopper pin and/or the auxiliary stopper surfaces are subjected to heat treatment.

12. The valve timing adjusting system according to claim 8, wherein the auxiliary stopper pin and/or the auxiliary stopper surfaces are subjected to surface treatment.

13. The valve timing adjusting system according to claim 1, wherein the main angle-limiting mechanism comprises;

a main stopper pin formed in a tubular shape and passing through the vane rotor in its axial direction and projecting from the vane rotor into at least one of axial ends of the housing;

a groove formed at the axial end of the housing, into which one of axial ends of the main stopper pin projects; and stopper surfaces formed at circumferential ends of the groove for defining the main angular range, wherein the main stopper pin is brought into contact with the stopper surfaces in a circumferential direction of the groove, so that the rotational phase difference is controlled at the value within the main angular range, and wherein the valve timing adjusting system comprises an auxiliary angle-limiting mechanism, which has an auxiliary stopper pin coaxially provided with and arranged in the main stopper pin and a shock-absorbing member provided between the main stopper pin and the auxiliary pin.

14. The valve timing adjusting system according to claim 1, wherein the main angle-limiting mechanism comprises;

a first groove formed at an axial end of the housing and having a first circumferential end surface;

a first main projection formed at an axial end of the vane rotor and projecting into the first groove, the first main projection being in contact with the first circumferential end surface when the vane rotor is moved to its most retarded position;

a second groove formed at the axial end of the housing and having a second circumferential end surface; and a second main projection formed at the axial end of the vane rotor and projecting into the second groove, the second main projection being in contact with the second circumferential end surface when the vane rotor is moved to its most advanced position.

15. The valve timing adjusting system according to claim 14, further comprising;

an auxiliary angle-limiting mechanism which comprises;

a first auxiliary projection formed at the axial end of the vane rotor and projecting into the first groove, the first auxiliary projection being formed at a position next to the first main projection on a side opposite to the first circumferential end surface; and a second auxiliary projection formed at the axial end of the vane rotor and projecting into the second groove, the second auxiliary projection being formed at a position next to the second main projection on a side opposite to the second circumferential end surface.

16. A valve timing adjusting system for an engine comprising:

a valve timing adjusting device provided in a rotation transmitting system, in which rotation of the engine is transmitted from a crankshaft shaft of the engine to a cam shaft for opening and closing an intake valve and/or an exhaust valve, for adjusting a valve opening/closing timing of the intake valve and/or the exhaust valve;

an oil pressure control valve for controlling oil pressure of working oil to be supplied to an advancing chamber and a retarding chamber of the valve timing adjusting device; and an electronic control unit for controlling an operation of the oil pressure control valve depending on an operational condition of the engine, wherein the valve timing adjusting device comprises;

a housing member having a bottom wall at its one axial end;

a sprocket fixed to the other axial end of the housing member and connected to the crankshaft, so that the housing member and the sprocket are rotated together with the crankshaft;

a vane rotor movably accommodated in the housing member and connected to the cam shaft, so that the vane rotor is rotated together with the cam shaft, the vane rotor being rotatable relative to the housing member so that a rotational phase difference between the housing member and the vane rotor is changed when a relative movement of the vane rotor to the housing member is adjusted, the vane rotor having a vane for defining the advancing chamber and the retarding chamber; and a main angle-limiting mechanism for mechanically limiting the relative movement of the vane rotor to the housing member, so that the rotational phase difference is controlled at a value within a main angular range which is smaller than a predetermined angular range, and wherein electronic control unit comprises;

an abnormal condition detecting portion for determining whether the rotational phase difference is out of the main angular range or not;

a target-value setting portion for setting a target value for the rotational phase difference when the control unit determines that the rotational phase difference is out of the main angular range, wherein the target value is set as such a value within a restricted angular range which is smaller than the main angular range; and a valve driving portion for controlling the oil pressure control valve in order that the rotational phase difference coincides with the target value.

17. The valve timing adjusting system according to claim 16, wherein the main angle-limiting mechanism comprises;

a main stopper pin passing through the vane rotor in its axial direction and projecting from the vane rotor into the sprocket and the bottom wall of the housing member;

a first groove formed in the sprocket and having circumferential end surfaces, a first axial end of the main stopper pin projecting into the first groove; and a second groove formed in the bottom wall of the housing member and having circumferential end surfaces, a second axial end of the main stopper pin projecting into the second groove, and wherein the main stopper pin is brought into contact with the circumferential end surfaces in a circumferential direction of the vane rotor, when the main angle-limiting mechanism works.

18. The valve timing adjusting system according to claim 16, further comprising;

an auxiliary angle-limiting mechanism for mechanically limiting the relative movement between the housing member and the vane rotor in order that the rotational phase difference is controlled at a value within an auxiliary angular range, which is larger than the main angular range but smaller than the predetermined angular range.

19. The valve timing adjusting system according to claim 18, wherein the auxiliary angle-limiting mechanism comprises;

an auxiliary stopper pin passing through the vane rotor in its axial direction and projecting from the vane rotor into the sprocket and the bottom wall of the housing member;

a first auxiliary groove formed in the sprocket and having circumferential end surfaces, a first axial end of the auxiliary stopper pin projecting into the first auxiliary groove; and a second auxiliary groove formed in the bottom wall of the housing member and having circumferential end surfaces, a second axial end of the auxiliary stopper pin projecting into the second auxiliary groove, and wherein the auxiliary stopper pin is brought into contact with the circumferential end surfaces in a circumferential direction of the vane rotor, when the auxiliary angle-limiting mechanism works.

* * * * *